US009327870B2

(12) United States Patent
Jian et al.

(10) Patent No.: US 9,327,870 B2
(45) Date of Patent: May 3, 2016

(54) HINGE SYSTEM AND COLLAPSIBLE CONTAINER

(75) Inventors: Yuanli Jian, Shanghai (CN); Qingxin Liao, Shanghai (CN); Zuocheng Qian, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 32 days.

(21) Appl. No.: 14/348,386

(22) PCT Filed: Jul. 9, 2012

(86) PCT No.: PCT/CN2012/078369

§ 371 (c)(1),
(2), (4) Date: May 7, 2014

(87) PCT Pub. No.: WO2013/044664

PCT Pub. Date: Apr. 4, 2013

(65) Prior Publication Data

US 2014/0231425 A1 Aug. 21, 2014

(30) Foreign Application Priority Data

Sep. 29, 2011 (CN) ..... 2011 1 0295485

(51) Int. Cl.
*B65D 21/08* (2006.01)
*B65D 19/06* (2006.01)
*E05D 3/06* (2006.01)

(52) U.S. Cl.
CPC ..... *B65D 21/086* (2013.01); *B65D 19/06* (2013.01); *E05D 3/06* (2013.01);

(Continued)

(58) Field of Classification Search
CPC ..... B65D 19/06; B65D 21/086; E05D 3/06; Y10T 16/5448
USPC ..... 220/7, 700; 16/369
See application file for complete search history.

(56) References Cited

U.S. PATENT DOCUMENTS 5,938,059 A 8/1999 Luburic
6,152,317 A 11/2000 Newby, Sr.

(Continued)

FOREIGN PATENT DOCUMENTS

CN 101117171 2/2008
CN 102502124 6/2012

(Continued)

OTHER PUBLICATIONS

International Search Report for PCT/CN2012/078369, dated Sep. 19, 2012.

(Continued)

*Primary Examiner* — Fenn Mathew
*Assistant Examiner* — Elizabeth Volz
(74) *Attorney, Agent, or Firm* — Hamre, Schumann, Mueller & Larson, P.C.

(57) ABSTRACT

A hinge system comprises a first component and a second component. Arranged on the first component, a first pin (314) and a second pin (324) are not on a same axis. The first pin is movably arranged in a first slot (814) on the second component. The second pin is movably arranged in a second slot (824) on the second component. The first component selectively stays in a first position state or a second position state relative to the second component, thus allowing the hinge system to be folded reliably and conveniently. Also a collapsible container comprising the hinge system is disclosed.

10 Claims, 10 Drawing Sheets

(52) U.S. Cl.
CPC ..... *B65D 2519/009* (2013.01); *B65D 2519/00582* (2013.01); *B65D 2519/00651* (2013.01); *B65D 2519/00805* (2013.01); *B65D 2519/00975* (2013.01); *Y10T 16/5475* (2015.01)

(56) References Cited

U.S. PATENT DOCUMENTS

| | | | | |
|---|---|---|---|---|
| 7,287,661 | B2 * | 10/2007 | Knutsson | B65D 11/1833 220/7 |
| 7,331,480 | B1 | 2/2008 | Nolan | |
| 2001/0035412 | A1 * | 11/2001 | Kofod | B65D 19/12 220/7 |
| 2004/0182858 | A1 | 9/2004 | Smyers | |

FOREIGN PATENT DOCUMENTS

| | | |
|---|---|---|
| CN | 202368860 | 8/2012 |
| DE | 102009005212 | 7/2010 |
| JP | 2006298468 | 11/2006 |
| WO | WO 2005/102850 | 11/2005 |

OTHER PUBLICATIONS

Extended European Search Report, May 4, 2015; European Patent Application No. 12836349.6 (5 pages).

* cited by examiner

HINGE SYSTEM AND COLLAPSIBLE CONTAINER

TECHNICAL FIELD

The disclosure relates to a hinge system for connecting two components and a collapsible container.

BACKGROUND OF THE INVENTION

Empty container or box with fixed side walls requires a lot of space for storing, and therefore, the existing container includes collapsible side walls, thereby reducing the space occupied by the container during transport. Most of these collapsible containers comprise a base in form of rectangular plate structure, wherein the collapsible side walls are coupled to the edges of the base by hinges. The side walls may be interlocked when the container stay erected, usually through engaging the latch of one side wall with the hook of another side wall.

For many containers, the side walls are configured to be higher than half of the width of the base, thus the opposite side walls will be overlapped when they are folded towards each other. Therefore, the side wall which is folded later will go beyond the edge of the side wall which is folded first and will be not parallel to the base but angled. When pluralities of containers are overlapped, the upper side walls will he bent and deformed or damaged with time elapses. For such containers, another drawback is that several containers can not be stacked in a stable way.

To solve this problem, one solution is to connect the side walls to the rods of the base at different height respectively. However, the height of the opposite side walls are different, which leads to increase the cost of manufacturing and maintaining. Further, the workers must pay more attention during the operation which will affect the efficiency to some extend, since the folding work should be executed sequentially. It needs a more advanced alternative solution to solve this problem.

U.S. Pat. No. 5,938,059A disclosed a solution to solve the above problems. One side wall and the opposite side wall may overlap each other in a manner that the side walls are placed parallel to the base and the folding order is not limited through an oval hole provided on the base and a pin the base of the match, the pin being able to move up and down in the oval hole within a distance. This invention solves the problem of folding container to a certain extent. Also, the side walls of container are same with each other. However, it needs additional pins or tubes as pivot shafts and tools should be used to operate the pivot shafts when assembly or disassembly the side walls, which will lower the efficiency.

WO2005102850A1 proposed a more advanced solution with respect to the above solution. The solution of WO2005102850A1 optimizes the assembly method of the side walls and the base. The solution of WO2005102850A1 comprises a side wall having two specific projections with widths (w1, w2) respectively, the base having a recess with an opening. When the side wall is rotated to 45 degrees with respect to the base, the minimum width w2 of the projection may exactly pass through the opening of the recess so that the side walls and the base are assembled or disassembled. The side walls and the base may be assembled or disassembled without tools according to WO2005102850A1.

However, both application need an additional mechanism for moving the erected side walls up and down when lock the side walls to the base, and it is troublesome for assembly or disassembly the side walls according to U.S. Pat. No. 5,938,059A. Further, there is a large space for moving the pivot shafts during the rotation of the side walls according to WO2005102850A1, which leads to a poor operating experience.

SUMMARY OF THE INVENTION

The object of the invention is to provide a hinge system and a collapsible container.

To achieve the above object, a hinge system is provided, comprising: a first pin and a second pin provided on a first component; a first slot and a second slot provided on two sides of a concave portion of a second component respectively; wherein the concave portion is formed with one side open and the second slot is formed with a first pit, a second pit being provided on one of the first slot and the second slot; the first pin and the second pin are not on a same axis, the first pin being movably arranged in the first slot, the second pin being movably arranged in the second slot; the first component selectively switches between a first position state and a second position state relative to the second component; when the first component stays in the first position state, the first component is inserted into the second component, the second pin is received by the first pit so as to prevent the second pin from moving towards the notch of the second slot; the first pin acts as a pivot shaft of the rotation of the first component with respect to the second component; when the first component stays in the second position state, as compared to the first position state, the first component is rotated by a predetermined angle from the open side while moving towards the notch of the first slot or the second slot by a predetermined distance, then the first pin or the second pin is received by the second pit, so that the movement of the first pin or the second pin towards to the notch of the first slot or the second slot is limited by the second pit.

The further characteristic of the hinge system is that, the first component is erected with respect to the second component at the first position state, the first component superposing on the second component at the second position state; the first pin and the second pin are cylindrical pins with same diameter.

The further characteristic of the hinge system is that, the second pin acts as a pivot shaft of the first component after the first component switches from the first position state.

The further characteristic of the hinge system is that, the second slot is a shaped slot; the first pit is a pit located at the back side of the slot; the second pit is a width expanded portion at the front side of the slot, and the position of the width expanded portion is closer to the notch of the second slot than the position of the first pit; the first slot is a straight slot; the position of the first pin is higher than the position of the second pin when the side wall stays at the first position state.

The further characteristic of the hinge system is that, the second slot is a shaped slot; the first pit is a pit located at the front side of the slot; the second pit is a width expanded portion at the back side of the slot, and the position of the width expanded portion is closer to the notch of the second slot than the position of the first pit; the first slot is a straight slot; the position of the first pin is lower than the position of the second pin when the side wall stays at the first position state.

The further characteristic of the hinge system is that, the second slot is a shaped slot; the first pit is a pit located at the front side of the slot, the second pit is a width expanded portion at the back side of the slot, and the position of the width expanded portion is closer to the notch of the second slot than the position of the first pit; the first slot is a straight slot; the position of the first pin and the position of the second pin are of equal height when the side wall stays at the first position state.

The further characteristic of the hinge system is that, the first pit and the second pit are formed on a same side or formed on opposing sides.

The further characteristic of the hinge system is that, the first pit is formed on the first slot, and the first pit and the second pit are formed on a same side or formed on opposing sides of the first slot and the second slot respectively.

To achieve the above object, a collapsible container is also provided, comprising a base and several side walls mounted on the base, wherein at least one side wail is connected to the base through the above hinge system, wherein the first component is a side wall, and the second component is the base.

The further characteristic of the hinge system is that two opposing side walls are connected to the base through the hinge system respectively.

The first component is rotated towards the open side, so that the hinge system may switch between the first position state and the second position state, thus the side walls of large containers may be disassembled without using tools, and the side walls may be folded in any order. Further, it does not need additional mechanism to prevent the side walls from moving vertically when the side walls are erected.

DETAILED DESCRIPTION

Figure 1:
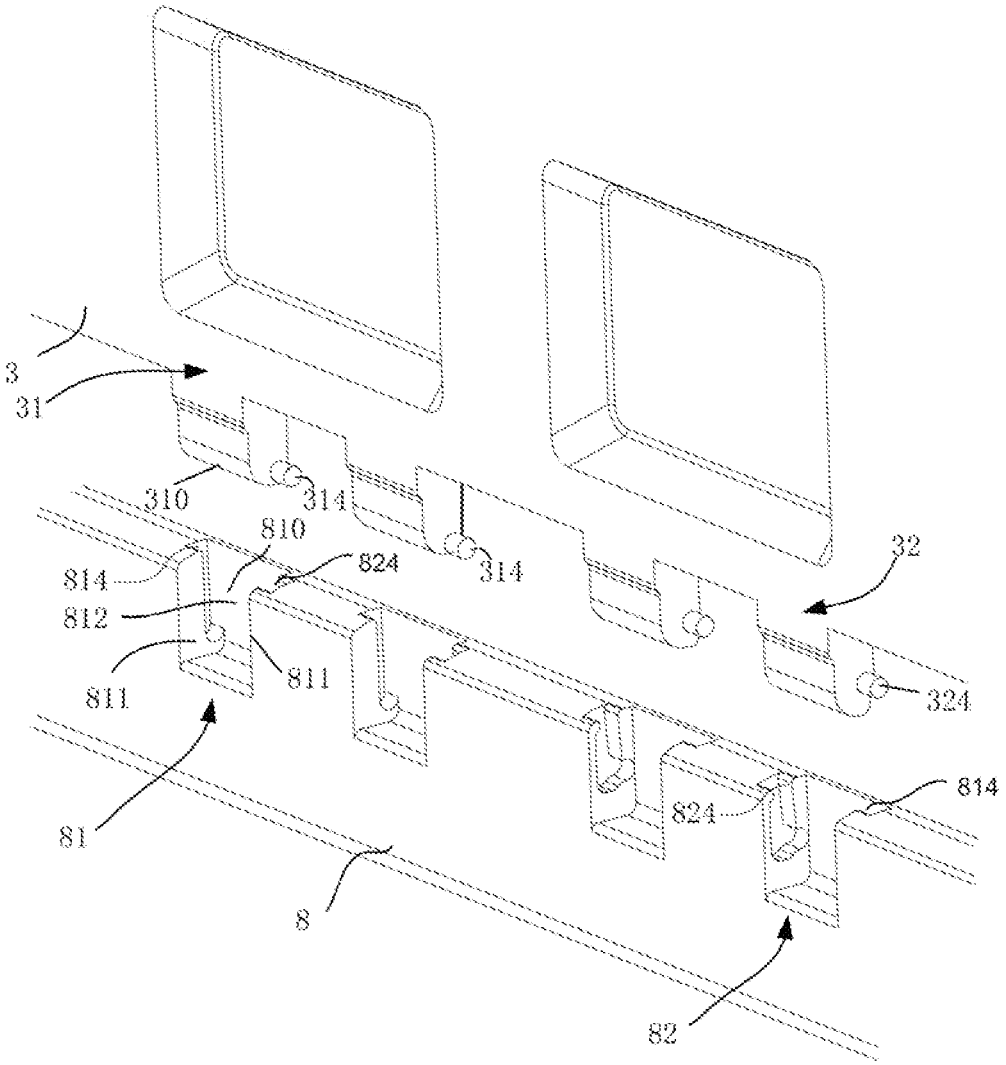
FIG. 1 is a schematic exploded view of the hinge system.

As shown in FIG. 1, the hinge system comprises a hinge, the hinge including plugs 32, 32 and receptacles 81, 82.

In FIG. 1, the plugs 31 and 32 have substantially the same structure, however, for easy to be shown, the plug 32 is shown with a second pin 324 and the plug 31 is shown with a first pin 314. In fact, each plug 31, 32 has a first pin 314 on one side thereof and a second pin 324 on the opposite side thereof. Specifically, in FIG. 1, the left side of plug 31 is provided with a second pin 324 (not shown), the right side of the plug 31 being provided with a first pin 314. The left side of the plug 32 is provided with a first pin 314 (not shown), the right side of the plug 32 being provided with a second pin 324. The structure of the plug 31 described later also suit for the plug 32.

In FIG. 1, the receptacles 81 and 82 have substantially the same structure, however, for easy to be shown, the receptacle 82 is shown with a second slot 824 and the receptacle 81 is shown with a first slot 814 in fact, each receptacle 81, 82 has a first slot 814 on the one side thereof and s second pin 824 on the opposite side thereof. Specifically, in FIG. 1, the right side of receptacles 81 is provided with a second slot 824 (not shown), the left side of the receptacle 81 being provided with a first slot 814. The right side of the receptacle 82 is provided with a first slot 814 (not shown), the left side of the receptacle 82 being provided with a second slot 824. The structure of the receptacle 81 described later also suit for the receptacle 82.

Receptacle 81 is provided with a concave portion 810 having two opposing guiding sidewalls 811 and an open side 812. One of the guiding sidewalk 811 is provided with the first slot 814, and the other guiding sidewall 811 is provided with a second slot 824.

FIG. 1 shows a plurality of concave portion, these portions also referred to as receptacle of a second member (base) to be connected by a hinge system.

The first slot and the second slot are provided on the two opposing guiding sidewalls in the same receptacle respectively. Alternatively, the two opposing guiding sidewalls of one receptacle are both provided with the first slots while the guiding sidewalk of other receptacles are all provided with the second slots. Alternatively, the two opposing guiding sidewalls of one receptacle are both provided with the second slots while the guiding sidewalls of other receptacles are all provided with the first slots. Alternatively, the first slot may be provided only on the one of the guiding sidewalls of one receptacle while another guiding sidewall of said receptacle and the guiding sidewalls of other receptacles are all provided with the second slots. In other words, it is not necessary to provide both the first slot and the second slot on each receptacle, but the first slot and the second slot can be provided on either guiding sidewalk of either receptacles, as long as the first slot and the second slot are both exit on the hinge system of the present invention regardless of the amount of the first slots and the second slots. Accordingly, the first component (side wall) and the second component (base) connected to each other by the hinge system herein may be provided with a first pin and a second pin on the plug of the first component.

The plug 31 has a projecting tongue portion 310, the first pin 314 and the second pin 324 being provided on opposite sides of the tongue portion 310, only one pin 314 being shown in the figure due to the projection angle.

The tongue portion 310 of the plug 31 is inserted into the concave portion 810 of the receptacle 81, and the first pin 314 is inserted into the corresponding, first slot 814. The first pin 314 may be moved or rotated in the first slot 814, and the tongue portion 310 can be turned and out of the open side 812 of the concave portion 810 of the receptacle 81. In one embodiment of the invention, the first slot 814 is a straight slot. The second pin 324 is inserted into the corresponding second slot 824, and the second pin 324 may be moved or rotated in the second slot 824. In one embodiment of the present invention, the second slot 824 is a shaped slot.

The first pin 314 is located at the bottom of the tongue portion 310, and the second pin 324 is located at the upper portion of the tongue portion 310. As shown in the figure, the position of the first pin 314 is lower than the position of the second pin 324.

Figure 2:
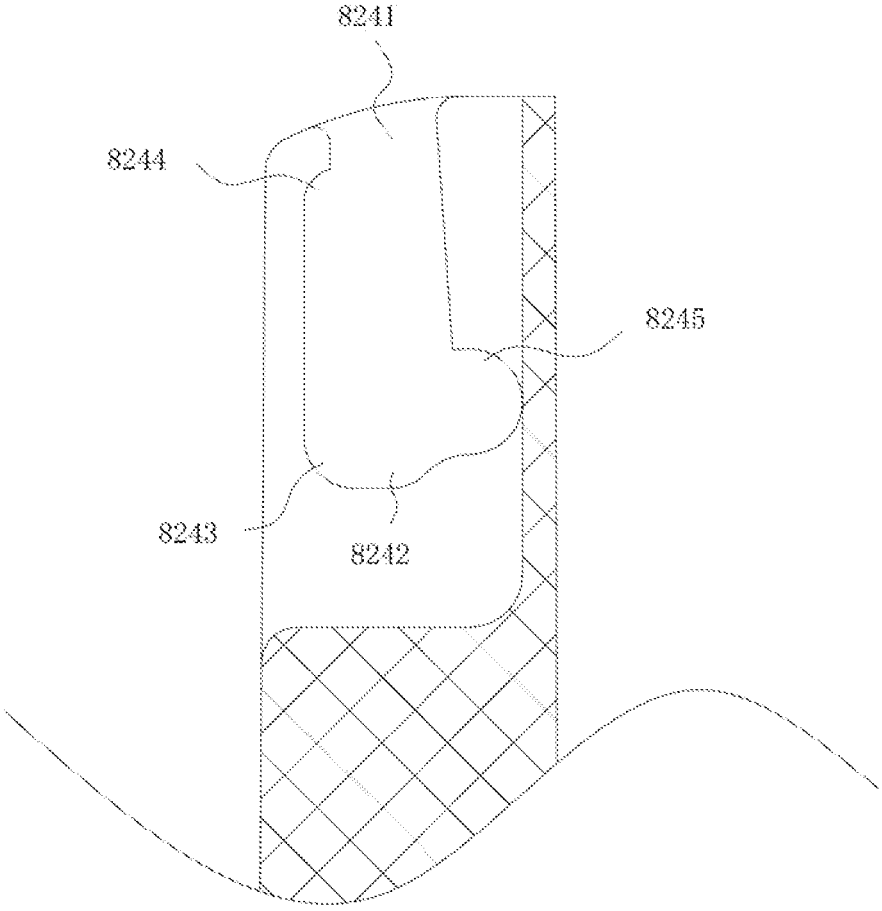
FIG. 2 is a schematic diagram of a shaped slot.

FIG. 2 shows a shape of the second slot 824. The second slot 8241 has a notch 8241, a bottom 8242, a front sidewall and a rear sidewall, the front sidewall and the rear sidewall being two opposing walls. The notch is an open end, a width expanded portion 8244 being provided on the first sidewall near the notch 8241, the width of the second slot 824 becoming larger at the width expanded portion so that a blocking shoulder is formed. The second sidewall is formed with an arc recess 8245 near the bottom 8242. The arc recess 8245 and the bottom 8242 are connected by an arc, also the bottom 8242 and the first sidewall are connected by an arc segment.

As shown in FIG. 1, the above mentioned hinges are mounted between the side wall 3 and the base 8, so that the side wall 3 can be rotated relative to the base 8. FIG. 1 shows that two first hinges and two second hinges are mounted between the side wall 3 and the base 8, for example. However, there may he at least one hinge. Further, the at least two tongue portions and at least two concave portions may be regarded as one tongue portion and one concave portion configured to be provided with the above mentioned slots and pins.

Figure 3:
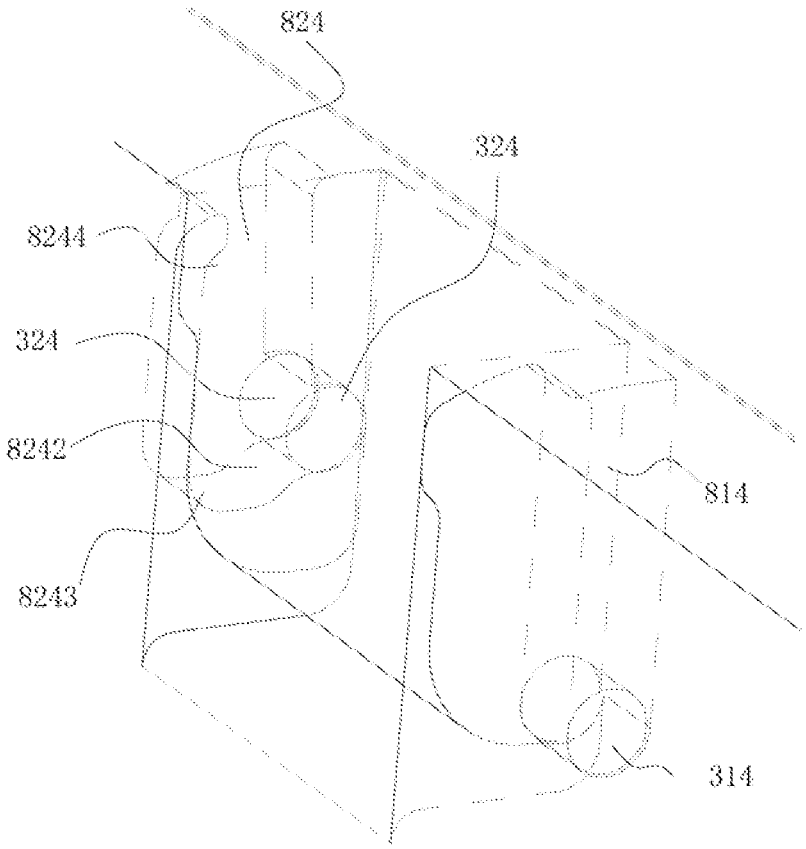
FIG. 3 is a state diagram of the initial position of the hinge system, wherein the coupled side walls are erected.

As shown in FIG. 3, when the first pin 314 is located at the bottom of the first slot 814, the pin 324 is located in the arc recess 8245 (first pit) of the second slot 824. Therefore, when the side wall 3 is attached to the base 8, the first pin 314 and second pin 324 enter into the first slot 814 and the second slot 824 respectively, then the side wall 3 is rotated by a angle so that the second pin 324 is located in the arc recess 8245, thus the side wall 3 and the base 8 may be assembled without using any tools.

As shown in FIG. 3, the side wall 3 is erect, the first pin 314 being located at the bottom of the first slot 814, the second pin 324 being located at the are recess of the sidewall of the second slot 824. The arc recess 8245 prevents the second pin 824 from moving upward, so that the side wall 3 can not move upward either. However, the arc recess 8245 allows the side wall to turn inwardly around the first pin 314 (i.e. turn towards the open side 812, 822 in FIG. 1).

Figure 4:
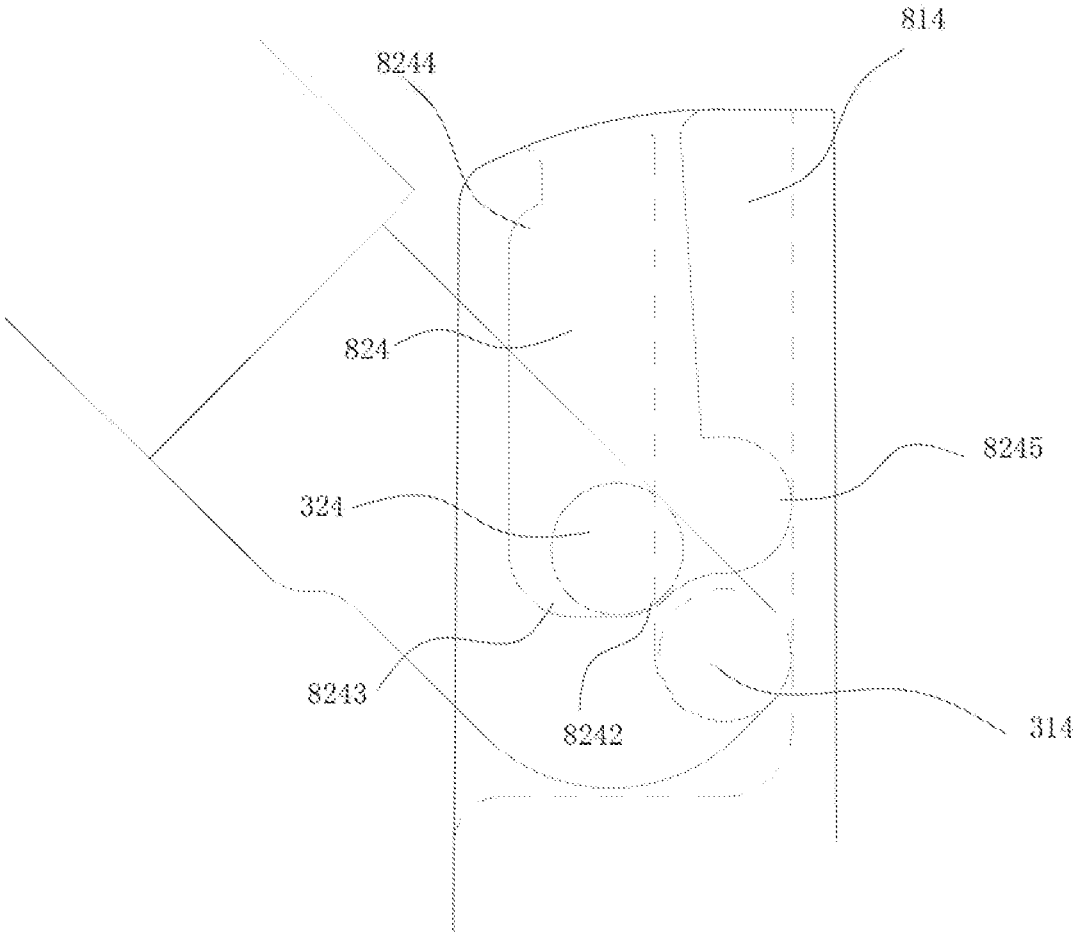
FIG. 4 is a state diagram of the hinge system after the coupled side walls being rotated by an angle.
Figure 5:
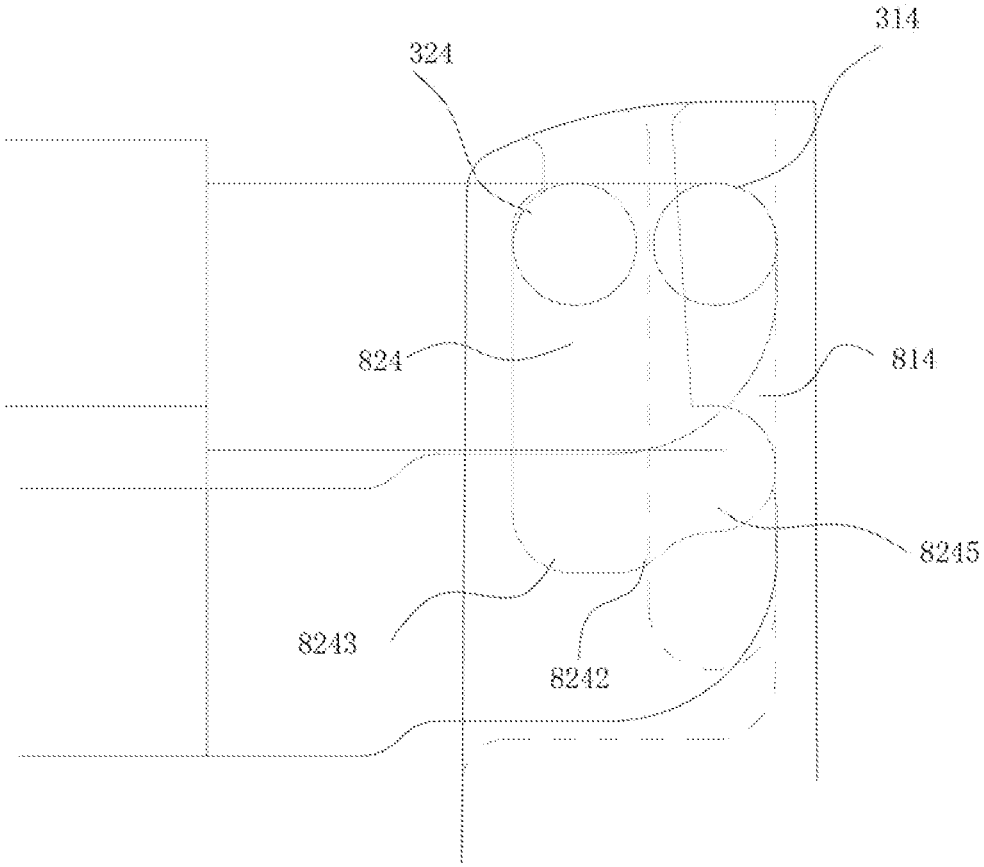
FIG. 5 is a state diagram of the hinge system when the coupled side walls are folded, wherein the coupled side walls lied down.

As shown in FIG. 4, the position of the first pin 314 is lower than the position of the second pin 324 and, in the initial state shown in FIG. 3, the first pin 314 contacts with the bottom of the first slot 814 so as to support the side wall 3, and the second pin 324 is located in the are recess 8245 so as to mainly prevent the side wall from moving upward. In FIG. 4, when the side wall 3 is rotated inward, the first pin 314 acts as the pivot shaft, thus the second pin 324 is rotated around the first pin and moves towards the bottom 8242 of the second slot 824. When the side wall 3 has reached to a predetermined angle, for example 45 degrees with respect to the horizontal position, the second pin 324 contacts with the bottom 8242 of the second slot 824, thus when the side wall continues to rotate, i.e., the side wall is folded, the second pin 324 will act as the pivot shaft of the side wall 3 and force the first pin 314 to move upward in the first slot 814. Further, the first pin 314 is tangent to the sidewall of the first slot 814, and the movement of the first pin 314 along the first slot 814 will force the second pin 324 to move toward an arc transition corner 8243 at the bottom 8242 of the second slot 824. When the second pin 324 reaches the arc transition corner 8243, there is no object over the second pin 324 and the first pin 314, thus the second pin 324 and the first pin 314 are not obstructed, such that the bottom of the side wall may be moved up vertically. After moving a distance, as shown in FIG. 5, when the side wall 3 is rotated to a folded state, the second pin 324 reaches the width expanded portion 8244 (second dent), and the width expanded portion 8244 prevents the second pin 324 from moving, so that the side wall 3 does not rotate any more. The side wall 3 stays at a folded state and does not need to rotate upward, the width expanded portion 8244 being used to lock the connection between the side wall 3 and the base when folded.

Figure 6:
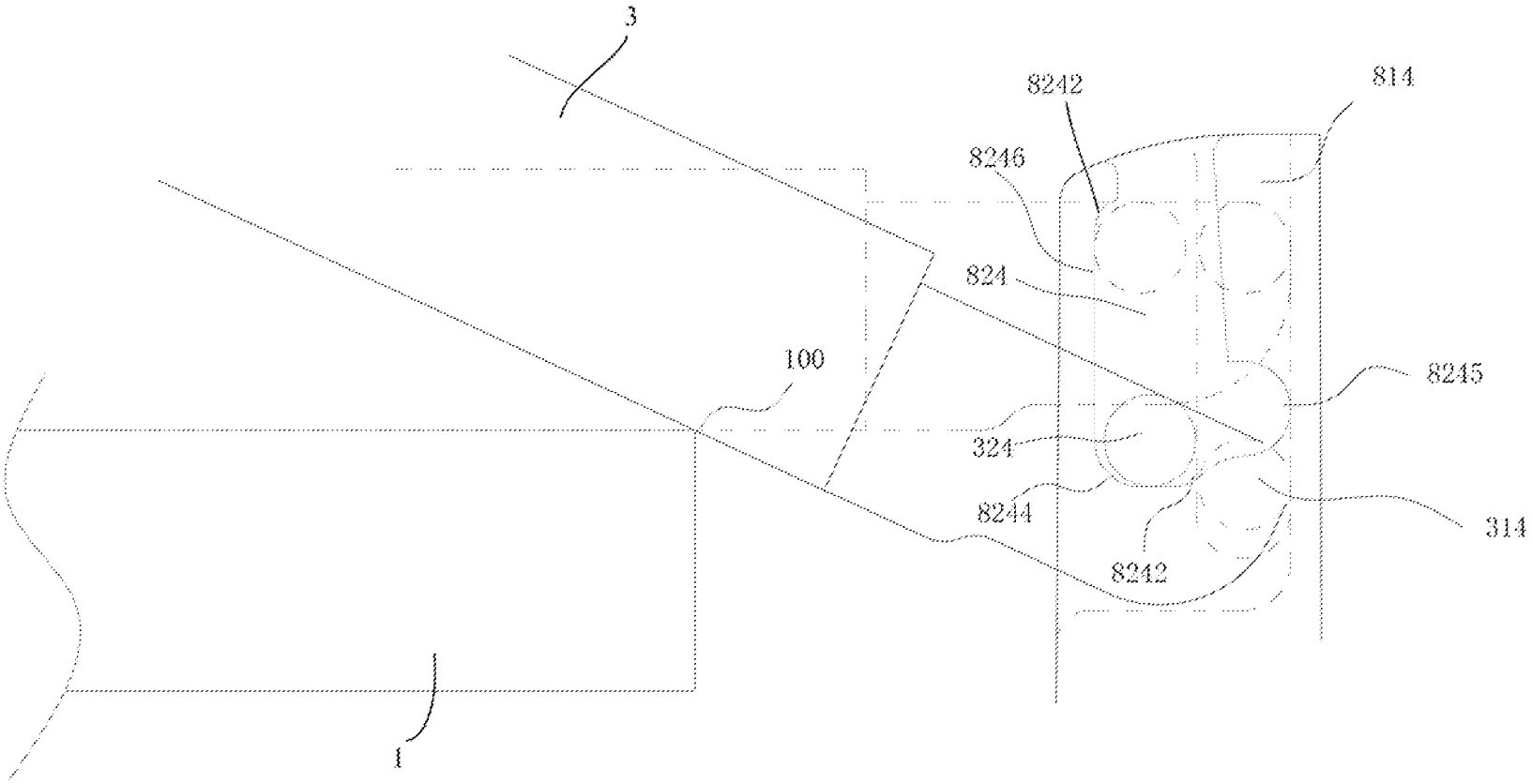
FIG. 6 is a schematic view of the opposite side walls during folding.

As shown in FIG. 6, after the opposite side wall 1 was folded, when the second pin 324 moves from the bottom 8242 of the second guiding slot 824 to the arc transition corner 8243 during folding the side wall 3, the second pin 324 will contact with the edge 100 of the side wall 1, and the side wall 3 will rotate against the edge 100. Then the pins 314, 324 move upward, and simultaneously the second pin 324 moves towards the first sidewall 8246 of the second slot 824. After the side wall 3 is folded, the side wall 3 is parallel to side wall 1 and superposes on the side wall 1 snugly. FIG. 6 shows both the folded side wall 3 and unfolded side wall 3, and it can be seen that the pin 314, 324 move upward by a distance. The effect is that two side walls will be superposed snugly one on another after being folded regardless which side wall is folded first.

When the side walls 1,3 are both folded, the distance between the respective pins 314, 324 of the two side walls 1, 3 (the side wall is connected to the base 8 using a same hinge) along the vertical direction is equal to the distance between the centers of the side walls 1, 3 along the vertical direction, thus the second slot 824 should allow the folded side wall 3 to move vertically by a distance which equal to the sum of the above distance and the diameter of the second pin 324, that is, the distance between the arc transition corner 8243 and the width expanded portion 8244 should be greater or equal to the sum of the above distance and the diameter of the second pin 324.

Figure 7:
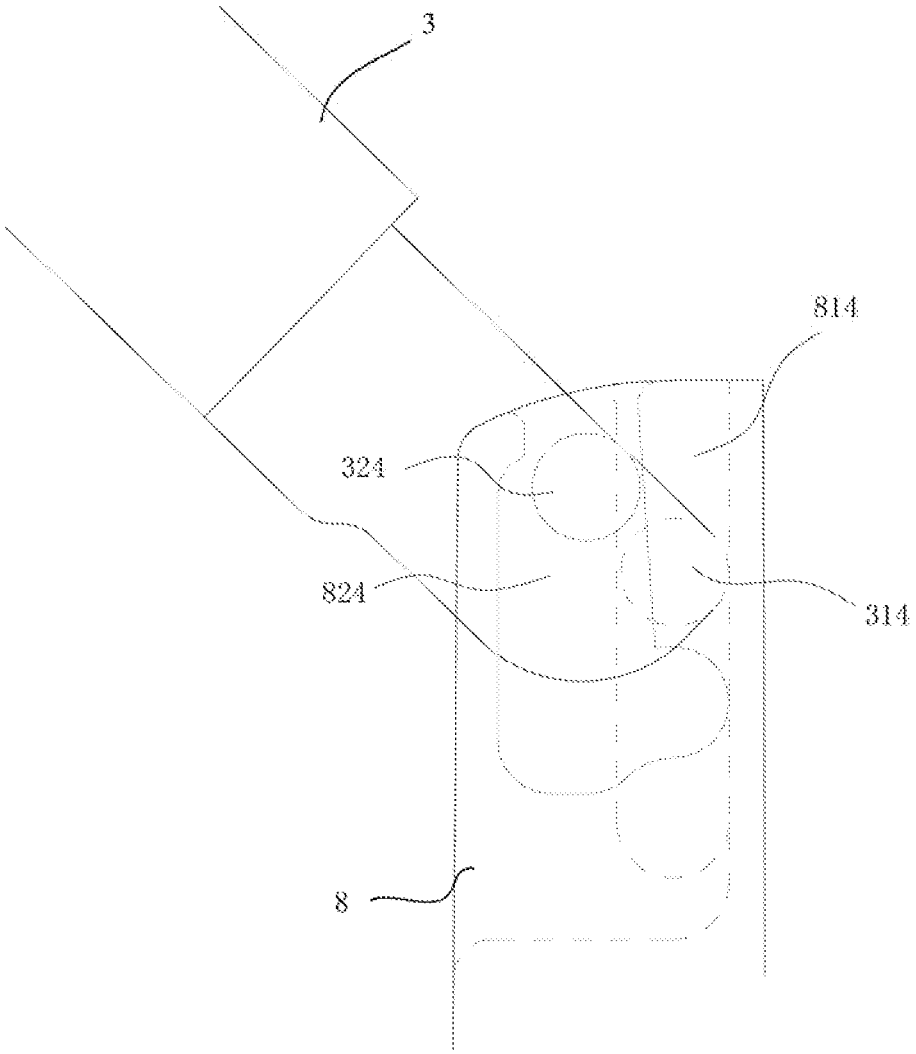
FIG. 7 is a schematic view of the binge system during disassembly.

As shown in FIG. 7, the width of opening of the second slot 824 is slightly larger than the diameter of the second pin 324, thus when the side wall 3 is disassembled from the base 8, the side wall 3 is rotated by 45 degrees such that the second pin 324 is disengaged from the arc recess 8245 of the second slot 824 and the unlock the side wall 3 and the base 8 in vertical direction. Thereafter, the side wall 3 is moved upward, the second pin will leave the second slot 824 from the opening of the second slot 824. At the same time, the first pin 314 will also leave the first slot 814. Therefore, the side wall 3 is disconnected from the base 5. The effect is that the side wall 3 and the base 8 may be disassembled without the aid of any tools.

Figure 8:
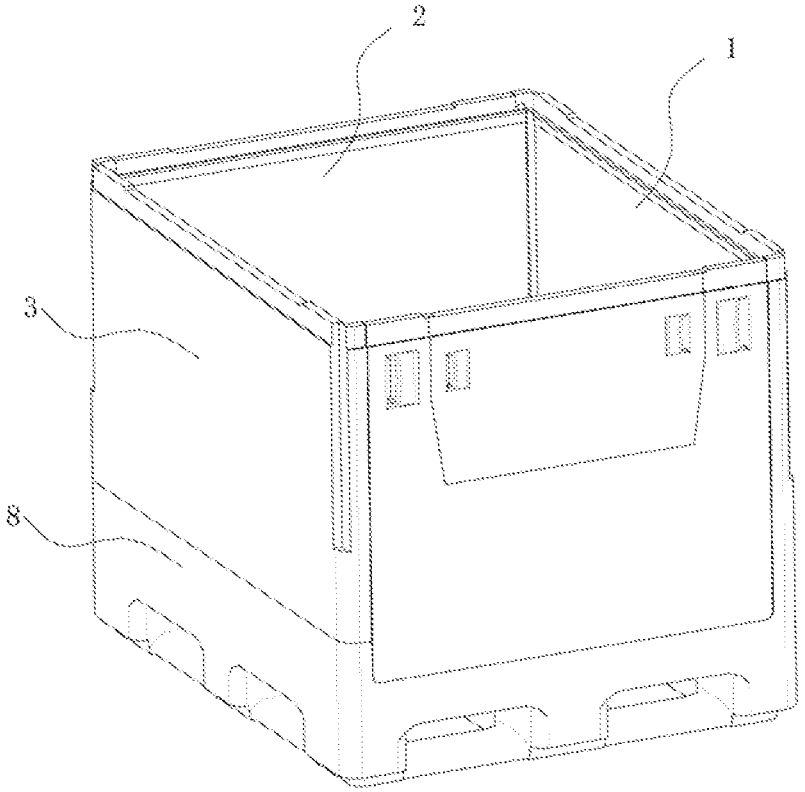
FIG. 8 is a perspective view of a collapsible container.

As shown in FIG. 8, a collapsible container, such as a carton, comprises a base 8 in form of rectangular plate structure, wherein the foldable side walls 1,2,3,4 are coupled to the edges of the base 8 through the above hinge system respectively. When the side walls 1, 2, 3, 4 are erected, the side walls 1, 2, 3, 4 will be connected with each other through locking members. There is at least one hinge system between each side walls 1, 2, 3, 4 and the base 8.

The principle of the above embodiment is that the horizontal distance between the two pins 314 and 324 is varied through rotating the side wall 3, such that the second pin will reach a limited position predetermined at the second slot. Therefore, the invention is not limited to the above embodiments. Alternatively, the first pin may be positioned at the first slot when the side walls are erected.

Figure 9:
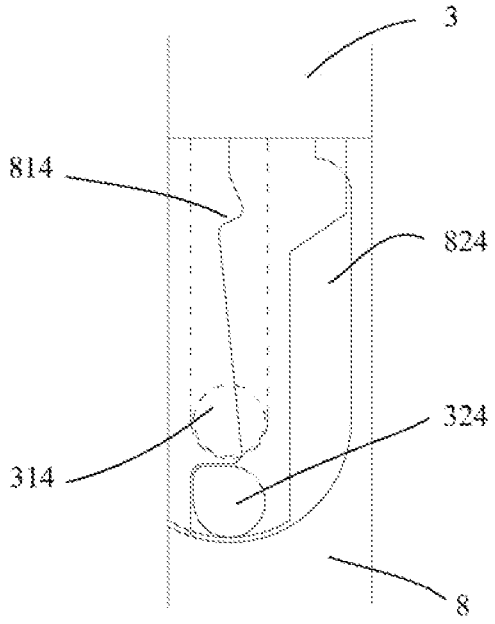
FIG. 9 is a state diagram of the initial position of the hinge system according another embodiment, wherein the coupled side walls are erected.
Figure 10:
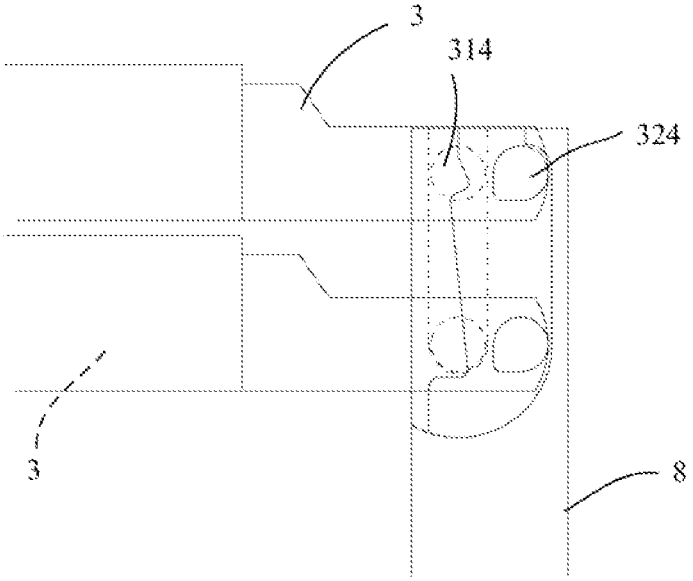
FIG. 10 is a state diagram of the hinge system according to another embodiment after the coupled side walls being rotated by an angle.

FIGS. 9 and 10 show another embodiment according to the invention, it is similar to the above embodiment, thus those same structures are canceled. In the embodiment, the first pin and the second pin are not located on a same line either. However, when the side wall 3 is erected, the second pin 324 located at a lower position will arrive at the pit of the second slot 824, so that the side wall 3 is prevented from moving upward by the pit (first pit). When the side wall 3 is folded, the second pin 324 is prevented front moving upward by the width expanded portion 8244 of the second slot 824.

Figure 11:
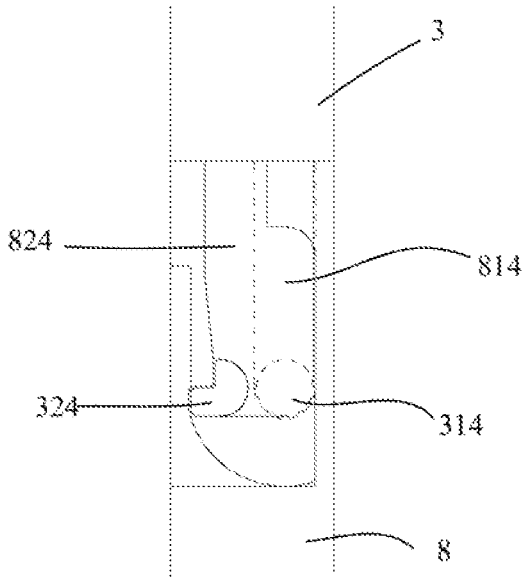
FIG. 11 is a state diagram of the initial position of the hinge system according yet another embodiment, wherein the coupled side walls are erected.
Figure 12:
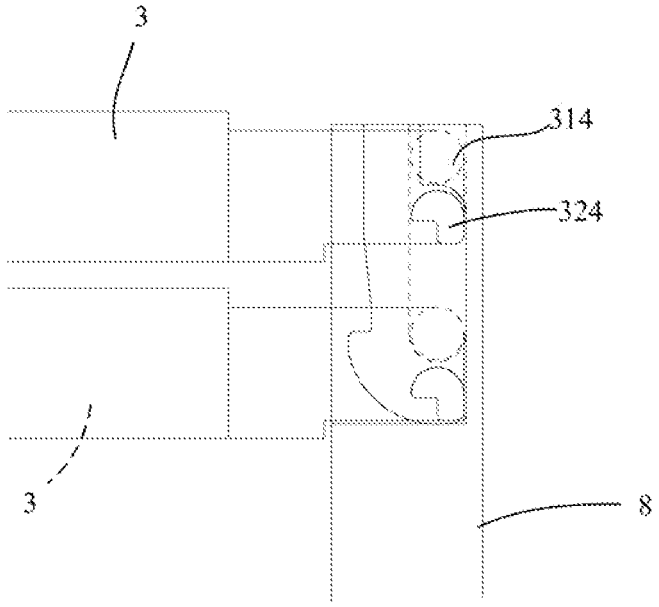
FIG. 12 is a state diagram of the hinge system according to yet another embodiment after the coupled side walls being rotated by an angle.

FIGS. 11 and 12 show another embodiment according to the invention, it is similar to the above embodiments, thus those same structures are canceled. In the embodiment, the first pin and the second pin are not located on a same line either. However, the first pin 314 and the second pin 324 are located at a same height. When the side wall 3 is erected, the second pin 324 located at left side (i.e. a side facing to the internal of the container) will arrive at the pit at the lower portion of the second 824, so that the side wall 3 is prevented from moving up by the pit (although the side wall may be slightly moved due to a manufacturing tolerance). When the side wall is folded, the second pin 324 is prevented from moving up by the upper right pit of the second slot 824 (the second pin may be slightly moved).

There are other variations, for example, the first pit and the second pit may be provided on different slots, such as the first pit is provided on the second slot, and the second is provided on the first slot.

In the foregoing embodiments, the first pin and the second pin may be cylindrical pins with same or different diameter. Alternatively, a plane may be formed on the cylindrical pin so as to contact with the pits, such that the movement of the pins is limited by the pits. Also, the first pin and the second pin can be other pins with a variety of other shapes.

The invention claimed is:

1. A hinge system, comprising:

a first pin and a second pin provided on a first component;

a first slot and a second slot provided in two sides of a concave portion of a second component respectively; wherein the concave portion is formed with one side open and the second slot is formed with a first pit, a second pit being provided on one of the first slot and the second slot;

the first pin and the second pin are not on a same axis, the first pin being movably arranged in the first slot, the second pin being movably arranged in the second slot;

the first component selectively switches between a first position state and a second position state relative to the second component; when the first component stays in the first position state, the first component is inserted into the second component, the second pin is received by the first pit so as to prevent the second pin from moving towards the notch of the second slot; the first pin acts as a pivot shaft of the rotation of the first component with respect to the second component; when the first component stays in the second position state, as compared to the first position state, the first component is rotated by a predetermined angle from the open side while moving towards the notch of the first slot or the second slot by a predetermined distance, then the first pin or the second pin is received by the second pit, so that the movement of the first pin or the second pin towards to the notch of the first slot or the second slot is limited by the second pit.

2. The hinge system as claimed in claim 1, wherein the first component is erected with respect to the second component at the first position state, the first component superposing on the second component at the second position state; the first pin and the second pin are cylindrical pins with same diameter.

3. The hinge system as claimed in claim 1, wherein the second pin acts as a pivot shaft of the first component after the first component switches from the first position state.

4. The hinge system as claimed in claim 1, wherein the second slot is a shaped slot; the first pit is a pit located at the front side of the slot; the second pit is a width expanded portion at the back side of the slot, and the position of the width expanded portion is closer to the notch of the second slot than the position of the first pit; the first slot is a straight slot; the position of the first pin is lower than the position of the second pin when the side wall stays at the first position state.

5. The hinge system as claimed in claim 1, wherein the first pit and the second pit are formed on a same side or formed on opposing sides.

6. The hinge system as claimed in claim 1, wherein the first pit is formed on the first slot, and the first pit and the second pit are formed on a same side or formed on opposing sides of the first slot and the second slot respectively.

7. The hinge system as claimed in claim 1, wherein the second slot is a shaped slot, the first pit is a pit located at the back side of the slot; the second pit is a width expanded portion at the front side of the slot; and the position of the width expanded portion is closer to the notch of the second slot than the position of the first pit; the first slot is a straight slot; the position of the first pin is higher than the position of the second pin when the side wall stays at the first position state.

8. The hinge system as claimed in claim 7, wherein the second slot is a shaped slot, the first pit is a pit located at the front side of the slot; the second pit is a width expanded portion at the back side of the slot, and the position of the width expanded portion is closer to the notch of the second slot than the position of the first pit; the first slot is a straight slot; the position of the first pin and the position of the second pin are of equal height when the side wall stays at the first position state.

9. A collapsible container comprises a base and several side walls mounted on the base, wherein at least one side wall is connected to the base through the hinge system according to claim 1, wherein the first component is a side wall, and the second component is the base.

10. The collapsible container as claimed in claim 9, wherein two opposing side walls are connected to the base through the hinge system respectively.

* * * * *